US007207904B2

(12) United States Patent
Isogawa et al.

(10) Patent No.: US 7,207,904 B2
(45) Date of Patent: Apr. 24, 2007

(54) GOLF BALL

(75) Inventors: Kazuhiko Isogawa, Kobe (JP); Koichi Fujisawa, Kobe (JP); Yoshikazu Yabuki, Kobe (JP)

(73) Assignee: SRI Sports Limited, Kobe (JP)

( * ) Notice: Subject to any disclaimer, the term of this patent is extended or adjusted under 35 U.S.C. 154(b) by 66 days.

(21) Appl. No.: 11/058,186

(22) Filed: Feb. 16, 2005

(65) Prior Publication Data

US 2005/0192122 A1 Sep. 1, 2005

(30) Foreign Application Priority Data

Mar. 1, 2004 (JP) ..... 2004-056682

(51) Int. Cl.
*A63B 37/12* (2006.01)

(52) U.S. Cl. ..... 473/378

(58) Field of Classification Search ..... 473/351, 473/378

See application file for complete search history.

(56) References Cited

U.S. PATENT DOCUMENTS

| | | | | |
|---|---|---|---|---|
| 5,100,770 | A * | 3/1992 | Ashida | 430/523 |
| 6,336,870 | B1 * | 1/2002 | Kato et al. | 473/351 |
| 2005/0187336 | A1 * | 8/2005 | Yokota | 524/497 |

FOREIGN PATENT DOCUMENTS

JP 2003-52859 A 2/2003

* cited by examiner

*Primary Examiner*—Raeann Gorden
(74) *Attorney, Agent, or Firm*—Birch, Stewart, Kolasch & Birch, LLP

(57) ABSTRACT

A golf ball has a core, and a cover for covering the core. The cover contains 0.5 to 10 parts by mass of a titanium oxide relative to 100 parts by mass of a base resin composing the cover, and the titanium oxide is surface-treated with an oxide including at least one element selected from the group consisting of aluminum, silicon, zinc, zirconium, tin, and cerium, and/or a hydrate thereof The golf ball has less or no discoloration or degradation with time, and has superior weatherability.

10 Claims, 1 Drawing Sheet

GOLF BALL

BACKGROUND OF THE INVENTION

1. Field of the Invention

The present invention relates to a golf ball, and more specifically to a golf ball comprising a core, and a cover for covering the core.

2. Description of the Related Art

A golf ball used outdoors may likely to cause discoloration with time due to exposure to UV rays (sunlight), wind or rain, or peeling of a coat or crack in the ball may likely to occur due to repeated impacts exerted to the ball. Such discoloration or peeling of the coat is not desirable because it gives an impression that the golf ball is degraded. Various attempts have been made to keep the external appearance of a golf ball good by improving weatherability or durability of the golf ball. For instance, Japanese Unexamined Patent Publication No. 11-216200 discloses a golf ball having improved external appearance with increased whiteness of a cover, wherein a titanium oxide (a white pigment), a red pigment, and a blue pigment are included in respective predetermined contents in a cover composition. Further, Japanese Unexamined Patent Publication No. 2003-52859 proposes a golf ball with improved durability and weatherability, wherein a urethane clear coat is formed as an outermost layer of the golf ball, and an epoxy resin clear coat is formed between the surface of a cover of the golf ball and the urethane clear coat. The epoxy resin clear coat has adhesiveness both to the cover and to the urethane clear coat and is less likely to cause discoloration.

The former publication discloses an art of raising whiteness of a golf ball by optimizing the composition ratio of pigments such as titanium oxide, but does not intend to prevent discoloration of a cover itself. If the resin composing the cover is degraded or causes discoloration by exposure to UV rays or the like, the ball surface shows the tone of the discolored cover because the clear coat formed on the ball surface is colorless and transparent, which makes it difficult or impossible to hide the degradation of the external appearance of the golf ball.

The latter publication aims at raising weatherability and durability of the clear coat, but does not aim at improvement of weatherability of the golf ball itself. Furthermore, in this technology, two coating steps are required: one is to form the epoxy resin clear coat; and the other is to form the urethane clear coat, which is not desirable in the point of simplifying the coating process.

In addition to the above drawback, there is likelihood that photocatalytic action of the titanium oxide to be added as a white pigment may degrade the resin composing the cover, thereby deteriorating weatherability of the golf ball.

Specifically, by exposure to UV rays, an electron-hole pair consisting of a free electron ($e^-$) on a conduction band and a positive hole ($p^+$) on a valance electron band is generated in the titanium oxide due to excitation of the electron on the valance electron band, as represented by the following formula (1).

$$TiO_2+h_\nu \rightarrow p^+ + e^- \quad (1)$$

The positive hole ($p^+$) is entrapped by $OH^-$ in adsorbed water on the surface of the titanium oxide, thereby generating an $\dot{O}H$ free radical, as represented by the formula (3). The generated free radical decomposes a resin component by its powerful oxidizing action.

$$H_2O \rightarrow H^+ + OH^- \quad (2)$$

$$OH^- + p^+ \rightarrow \dot{O}H \quad (3)$$

The free electron ($e^-$) reduces $Ti^{4+}$ in a crystal of the titanium oxide to $Ti^{3+}$ as represented by the formula (4). Subsequently, $O_2$ in the air is adsorbed to the $Ti^{3+}$, and turns to $O_2^-$ as represented by the formula (5). Then, the $O_2^-$ is reacted with the $H^+$ in the formula (2), and turns to an $H\dot{O}_2$ free radical while undergoing the reaction as represented by the formula (6). Similarly to the $\dot{O}H$ free radical, the $H\dot{O}_2$ free radical decomposes the resin component around the titanium oxide by its powerful oxidizing action.

$$[Ti^{4+}] + e^- \rightarrow [Ti^{3+}] \quad (4)$$

$$[Ti^{3+}] + O_2 \rightarrow [Ti^{4+}] + O_2^- \quad (5)$$

$$O_2^- + H^+ \rightarrow H\dot{O}_2 \quad (6)$$

Normally, it is difficult to completely suppress the photocatalytic action even by inclusion of a UV absorber, a light stabilizer or a like component in the composition of the golf ball, which hinders sufficient improvement of weatherability of the golf ball.

SUMMARY OF THE INVENTION

In view of the problems residing in the prior art, an object of the present invention is to provide a golf ball having less discoloration or degradation with time, and having superior weatherability, and well-balanced repulsion performance.

According to an aspect of the present invention, a golf ball comprises a core, and a cover for covering the core. The cover contains 0.5 to 10 parts by mass of a titanium oxide relative to 100 parts by mass of a base resin composing the cover, and the titanium oxide is surface-treated with an oxide including at least one element selected from the group consisting of aluminum, silicon, zinc, zirconium, tin, and cerium, and/or a hydrate thereof.

The above golf ball is advantageous in suppressing photocatalytic action inherent to titanium oxide, and in suppressing discoloration or degradation of the resin cover arising from the photocatalytic action.

These and other objects, features and advantages of the present invention will become more apparent upon reading of the following detailed description along with the accompanying drawings.

DETAILED DESCRIPTION OF THE PREFERRED EMBODIMENTS OF THE INVENTION

A feature of a golf ball according to an embodiment of the present invention resides in that: the golf ball comprises a core, and a cover for covering the core; the cover contains 0.5 to 10 parts by mass of a titanium oxide relative to 100 parts by mass of a base resin composing the cover; and the titanium oxide is surface-treated with an oxide including at least one element selected from the group consisting of aluminum, silicon, zinc, zirconium, tin, and cerium, and/or a hydrate thereof. First, the titanium oxide (hereinafter, also called as "surface-treated titanium oxide") on a surface of which the oxide and/or the hydrate thereof is formed is described.

The surface-treated titanium oxide to be used in the embodiment of the present invention is not specifically limited, as far as the titanium oxide is surface-treated with the oxide and/or the hydrate thereof described above. An example of the surface-treated titanium oxide is the one in which an aluminum oxide, a silicon oxide, a zinc oxide, a zirconium oxide, a tin oxide, a cerium oxide and/or a hydrate thereof is formed on the particle surface of titanium oxide. Among these, a preferred example is the one in which an oxide including at least one element selected from the group consisting of aluminum, silicon, zirconium, tin, and cerium, and/or a hydrate thereof is formed on the particle surface of the titanium oxide because it is effective in improving weatherability.

It is conceived that use of the surface-treated titanium oxide is effective in suppressing degradation of the resin cover for the following reasons.

An $\dot{O}H$ free radical generated by exposure of the titanium oxide to UV rays has a powerful oxidizing action. The $\dot{O}H$ free radical is unstable, has a short life, and decomposes as represented by the following formula (7).

$$2\dot{O}H \rightarrow H_2O + O_2 \quad (7)$$

If the aforementioned oxide or hydrate thereof is formed on the surface of the titanium oxide, the decomposition as represented by the formula (7) is progressed by a catalytic action of the oxide or the like while the $\dot{O}H$ free radicals pass through these layers containing the oxide and/or the hydrate thereof. As a result, the quantity of free radicals involved in oxidative decomposition of the resin component of the cover is reduced, which resultantly suppresses degradation of the resin cover.

Figure 1A:
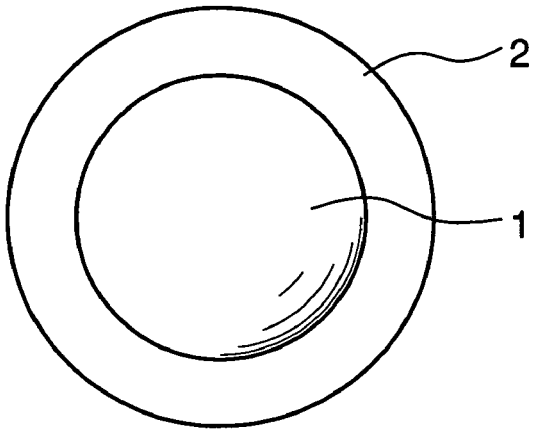
FIGS. 1A and 1B are illustrations showing examples of a titanium oxide applied with a surface treatment for suppressing photocatalytic action of the titanium oxide.
Figure 1B:
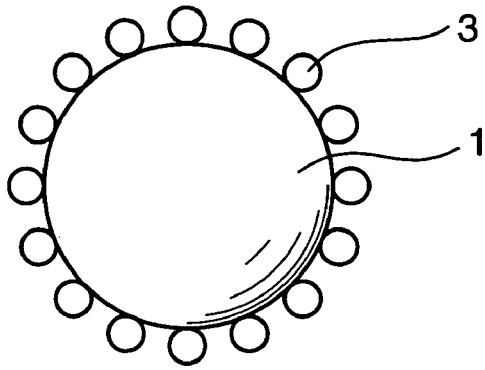

Exemplified manners as to how the oxide and/or the hydrate thereof is formed on the titanium oxide particle surface are the one as shown in FIG. 1A, in which a surface-treated layer 2 containing the oxide and/or the hydrate thereof is formed on the surface of the titanium oxide particle 1, and the one as shown in FIG. 1B, in which fine particles 3 containing the oxide and/or the hydrate thereof are adhered on the surface of the titanium oxide. Both of the surface-treated titanium oxides are applicable to the present invention, as far as they have been applied with a surface treatment at a content capable of suppressing photocatalytic action of the titanium oxide. Both of the surface-treated titanium oxides provide a resultant golf ball with an improved weatherability.

In some cases, the above elements each is used to impart light stability to the titanium oxide, and addition of the element also contributes to suppression of the photocatalytic action, with the result that weatherability of the resin component composing the cover is improved. Further, as a result of suppression of photocatalytic action of the titanium oxide, degradation of a clear coat resin in a coat for covering the cover surface arising from inclusion of the titanium oxide can be suppressed. Thereby, lowering of adhesiveness of the clear coat to the cover can be suppressed.

Furthermore, in the surface-treated titanium oxide which has been surface-treated by formation of the aforementioned oxide or the like, coagulation of the titanium oxides is less likely to occur. Accordingly, the surface-treated titanium oxide can be easily dispersed in the cover composition, with the result that color distribution non-uniformity hardly occurs. Also, uniform dispersion of the surface-treated titanium oxide in the cover allows the surface-treated titanium oxide to efficiently exhibit the function as a white pigment and UV absorbability. Thus, use of the surface-treated titanium oxide contributes to improvement of weatherability and external appearance of a resultant golf ball as well.

It is preferred to use the surface-treated titanium oxide in which at least one selected from the group consisting of silicon oxides, zirconium oxides, aluminum oxides, and hydrates thereof is formed on the surface of the titanium oxide particle. Examples of the surface-treated titanium oxide are "D-918" (surface treatment with $SiO_2.H_2O$, $ZrO_2.H_2O$, $Al_2O_3.H_2O$), "STR60C" (surface treatment with Al), "STR60S" (surface treatment with Ce/Sn/Zn/Al), "STR100A-L" (surface treatment with Si/Al), "R-21" (surface treatment with $SiO_2.Al_2O_3$), "R-32" (surface treatment with $Al_2O_3$), "R-61N" (surface treatment with $ZrO_2.Al_2O_3$), and "R-45M" (surface treatment with $SiO_2$ $.Al_2O_3$). All the products under the above trade names are produced by Sakai Chemical Industry Co., Ltd. Among these, "D-918" is preferred because particularly superior weatherability is obtainable.

The cover of the inventive golf ball contains 0.5 part by mass or more, preferably 1 part by mass or more, and more preferably 2 parts by mass or more of the surface-treated titanium oxide relative to 100 parts by mass of a base resin composing the cover. The surface-treated titanium oxide has UV absorbability, in addition to the function as a white pigment. As mentioned above, degradation (e.g., crack or discoloration) with time of the resin cover occurs due to decomposition of the resin component composing the ball body due to exposure to sunlight, particularly UV rays. In view of this, decomposition and discoloration of the resin cover can be prevented by decreasing the quantity of UV rays which may act on the resin cover by addition of the surface-treated titanium oxide. If the content of the surface-treated titanium oxide is lower than the lower limit, it is highly likely that the above properties are not obtainable.

Further, the rubber composition of the cover contains 10 parts by mass or less, preferably 8 parts by mass or less, and more preferably 6 parts by mass or less of the surface-treated titanium oxide relative to 100 parts by mass of a base resin. If the content of the surface-treated titanium oxide exceeds the upper limit, it is likely that the ratio of the resin component in the resin cover decreases, with the result that repulsion performance may be lowered.

Next, the base resin for composing the cover is described.

The composition of the cover of the inventive golf ball is not specifically limited, as far as the cover contains 0.5 to 10 parts by mass of the surface-treated titanium oxide relative to 100 parts by mass of a base resin composing the cover. Examples of the base resin composing the cover are ionomer resins, urethane resins such as a thermoplastic polyurethane resin and a 2-pack type curable urethane resin, and thermoplastic elastomers such as polystyrene and polyamide. These resins may be used alone or in combination of two or more kinds thereof. It is desirable to use 50 parts by mass or more, preferably 75 parts by mass or more, and more preferably 90 parts by mass or more of a urethane resin such as a thermoplastic urethane resin and a 2-pack type curable urethane resin, an ionomer resin, or a mixture of the urethane resin and the ionomer resin, relative to 100 parts of the base resin composing the cover in light of the fact that raising the content of the urethane resin or the ionomer resin enables to improve durability of the cover or shot feeling.

Examples of the ionomer resin for composing the cover are ionomer resins to be used as a cover material for a conventional golf ball, specifically, an ionomer resin produced by neutralizing at least a moiety of a carboxyl group in a binary copolymer of ethylene and α, β-unsaturated carboxylic acid with a metal ion, or an ionomer resin produced by neutralizing at least a moiety of a carboxyl group in a ternary copolymer of ethylene, α, β-unsaturated carboxylic acid and α, β-unsaturated carboxylic ester with a metal ion.

Examples of the metal ion for neutralization are: monovalent metal ions such as sodium ion, potassium ion, and lithium ion; bivalent metal ions such as zinc ion, calcium ion, magnesium ion, copper ion, and manganese ion; and trivalent metal ions such as aluminum ion, and neodymium ion. Particularly, zinc ion is preferred in the points that it exhibits a large cohesive force in coagulation of metal ions and that lowering of mechanical strength arising from dispersion of crosslinked diene rubber powders is small.

Examples of the ionomer resin are: products manufactured by Mitsui Dupont Polychemicals Co., Ltd. such as "Himilan 1605" (trade name of ionomer resin produced by using copolymer of sodium-ion-neutralized ethylene and methacrylic acid), "Himilan 1707" (trade name of ionomer resin produced by using copolymer of sodium-ion-neutralized ethylene and methacrylic acid), "Himilan 1706" (trade name of ionomer resin produced by using copolymer of zinc-ion-neutralized ethylene and methacrylic acid), "Himilan AM7315" (trade name of ionomer resin produced by using copolymer of zinc-ion-neutralized ethylene and methacrylic acid), "Himilan AM7317" (trade name of ionomer resin produced by using copolymer of zinc-ion-neutralized ethylene and methacrylic acid), "Himilan 1555" (trade name of ionomer resin produced by using copolymer of sodium-ion-neutralized ethylene and methacrylic acid), and "Himilan 1557" (trade name of ionomer resin produced by using copolymer of zinc-ion-neutralized ethylene and methacrylic acid); products manufactured by Exxon Chemical Company such as "Iotek 8000" (trade name of ionomer resin produced by using copolymer of sodium-ion-neutralized ethylene and methacrylic acid), "Iotek 7010" (trade name of ionomer resin produced by using copolymer of zinc-ion-neutralized ethylene and methacrylic acid); and products manufactured by Dupont Corp. such as "Surlyn 7930" (trade name of ionomer resin produced by using copolymer of lithium-ion-neutralized ethylene and methacrylic acid), "Surlyn 9945" (trade name of ionomer resin produced by using copolymer of zinc-ion-neutralized ethylene and methacrylic acid), and "Surlyn 8945" (trade name of ionomer resin produced by using copolymer of sodium-ion-neutralized ethylene and methacrylic acid).

Examples of the urethane resin for composing the cover are a 2-pack-type curable urethane resin which is produced by curing an isocyanate-group-terminated urethane prepolymer with an aromatic polyamine, and a thermoplastic urethane resin. It is preferable to use a thermoplastic polyurethane elastomer having an alicyclic diisocyanate as a constituent component in the aspect of improving discoloration resistance and scuff resistance of the cover.

A thermoplastic polyurethane elastomer generally has a polyurethane structure as a hard segment, and polyester or polyether as a soft segment. Generally, the polyurethane structure contains a curing agent component such as diisocyanate or amine. The thermoplastic polyurethane elastomer having an alicyclic diisocyanate as a constituent component means that the diisocyanate as the constituent component is an alicyclic diisocyanate.

Examples of the alicyclic diisocyanate are 4,4'-dicyclohexylmethane diisocyanate ($H_{12}$MDI), which is a hydrogenated 4,4'-diphenyhnethane diisocyanate (MDI), 1,3-bis(isocyanatomethyl)cyclohexane ($H_6$XDI), which is a hydrogenated xylylene diisocyanate (XDI), and one or more kinds of one selected from the group consisting of isophorone diisocyanate (IPDI) and trans-1,4-cyclohexane diisocyanate (CHDI). Among these, $H_{12}$MDI is preferred in terms of versatility and workability. Examples of the thermoplastic polyurethane elastomer using $H_{12}$MDI are "Elastoran XNY90A" (trade name), "Elastoran XNY97A" (trade name), and "Elastoran XNY585" (trade name), which are available from BASF Polyurethane Elastomers Ltd.

Generally, diisocyanate is classified into alicyclic diisocyanate, and aliphatic, diisocyanate, and aromatic diisocyanate. It is preferred to use diisocyanate that does not have a double bond in a backbone structure of a molecule thereof, namely, a thermoplastic polyurethane elastomer using an aliphatic diisocyanate and an alicyclic diisocyanate in the aspect of discoloration (yellowish discoloration) resistance. Further, it is preferred to use a thermoplastic polyurethane elastomer using an alicyclic diisocyanate having a large mechanical strength, and an aromatic diisocyanate, considering scuff resistance or the like. It is preferred to use a thermoplastic polyurethane elastomer using an alicyclic diisocyanate, as the thermoplastic polyurethane elastomer to be used in the cover of the inventive golf ball, considering both discoloration resistance and scuff resistance.

Examples of the thermoplastic elastomer usable as a base resin for composing the cover include thermoplastic polyamide elastomers sold under the trade name "Pebax" from Toray Co., Ltd., e.g., "Pebax 2533", thermoplastic polyester elastomers sold under the trade name "Hytrel" from Dupont-Toray Co., Ltd., such as "Hytrel 3548", and "Hytrel 4047", thermoplastic polyurethane elastomers sold under the trade name "Elastoran" from BASF Japan Ltd., such as "Elastoran ET880", and polystyrene elastomers sold under the trade name "Epofriend A1010" from Daicel Chemical Industries, Ltd., and the trade name "Septon HG252" from Kuraray Co., Ltd.

It is possible to use a mixture of the ionomer resin, the thermoplastic polyurethane resin, and the thermoplastic elastomer as a base resin for the cover. For instance, in the case where a mixture of a thermoplastic polyurethane elastomer having an alicyclic diisocyanate as a constituent component, and a thermoplastic polyamide elastomer is included as a base resin for composing the cover, the content of these components is 50% by mass or more, preferably 70% by mass or more, more preferably 90% by mass or more, and most preferably 100% by mass relative to the total content of the cover materials.

Generally, the thermoplastic polyamide elastomer has polyamide as a hard segment, and polyether or polyester as a soft segment. The thermoplastic polyamide elastomer to be used in the cover of the inventive golf ball may be a thermoplastic polyether polyamide elastomer or a thermoplastic polyester polyamide elastomer. Preferably, the thermoplastic polyether polyamide elastomer is used. Examples of the thermoplastic polyether polyamide elastomer include "Pebax 5533SN00" (trade name) available from Atofina Japan Co. Ltd.

It is desirable to set the blending ratio of the thermoplastic polyurethane elastomer to the thermoplastic polyamide elastomer in the range from 100:0 to 70:30, preferably from 98:2 to 80:20, and more preferably from 95:5 to 90:10. If the content of the thermoplastic polyamide elastomer is larger than 30% by mass, scuff resistance may be lowered.

It is possible to add an additive such as a colorant, a dispersant, an antioxidant, a UV absorber, a light stabilizer, a fluorescent material, or a fluorescent whitening agent as a cover material according to needs, in addition to the above resin components in such a content as not to impair a desirable property of the golf ball cover.

An ordinary known method for covering a core with a cover is usable as a method for covering the core in the embodiment of the present invention. An exemplified method comprises: molding a cover composition into a half shell of a substantially hollow hemispherical shape; encasing a core in two half shells; and heat-pressing the assembled half shells with the core in a die at a temperature from 160 to 200° C. for 1 to 10 minutes. Alternatively, the covering method comprises directly injection-molding the cover composition onto a core for enclosing the core therein. The former method adopting heat pressing is preferred to produce a golf ball having a shape substantially analogous to a true spherical shape.

Preferably, the cover has a thickness of 0.3 mm or larger, and more preferably 0.5 mm or larger, and 1.6 mm or smaller, and more preferably 0.9 mm or smaller. If the cover thickness exceeds 1.6 mm, a resultant golf ball has an excessive thickness, thereby decreasing a repulsion force and a flight distance. On the other hand, an excessively thin cover thickness makes it difficult to obtain sufficient covering effect, makes a molding operation difficult, and fails to produce a golf ball of a shape sufficiently analogous to a true spherical shape. In view of this, preferably, the cover thickness is 0.3 mm or larger.

It is desirable that the cover of the inventive golf ball has a Shore D hardness of 35 or more, preferably 40 or more, and more preferably 42 or more, and 55 or less, preferably 52 or less, and more preferably 50 or less. If the Shore D hardness is smaller than 35, a repulsion force may decrease, and if the Shore D hardness is larger than 55, the shot feel of the golf ball may be hard and poor. It should be appreciated that throughout the specification and claims, the cover hardness means a measured hardness of a sheet sample produced by heat-pressing a cover composition.

Next, the core of the inventive golf ball is described.

The structure of the inventive golf ball is not specifically limited, as far as the golf ball has a core and the aforementioned cover for covering the core, with the predetermined amount of the surface-treated titanium oxide being included in the cover. Examples of the inventive golf ball include a two-piece golf ball or a multi-piece golf ball comprising a solid core and a cover made of the aforementioned cover material for covering the solid core, and a thread-wound golf ball comprising a thread-wound core and a cover for covering the thread-wound core. The solid core may have a single-layered structure or a multi-layered structure comprising a center core and at least one intermediate layer for covering the center core. The kind of the center core of the single-layered solid core or the multi-layered solid core is not specifically limited. Preferably, the center core may be a vulcanized product made of a rubber composition containing a base rubber, a co-crosslinking agent, an organic peroxide, a filler, and the like.

As the base rubber, a natural rubber and/or a synthetic rubber used in a conventional solid golf ball is usable, and particularly, a so-called high cis polybutadiene rubber having cis bond of 40% or more, preferably 80% or more is preferred. It is possible to add a natural rubber, polyisoprene rubber, styrene polybutadiene rubber, ethylene-propylene-diene rubber (EPDM), or the like, in addition to the polybutadiene rubber, according to needs.

Examples of the co-crosslinking agent are monovalent or bivalent metal salts such as zinc salts or magnesium salts, which are metal salts of α,β-unsaturated carboxylic acid having 3 to 8 carbon atoms such as acrylic acid or methacrylic acid, or a mixture of one or more of these metal salts and acrylic ester or methacrylic ester. Zinc acrylate which imparts high repulsion performance to a golf ball is preferred. The content of the co-crosslinking agent is 10 parts by mass or more, and preferably 20 parts by mass or more, and 50 parts by mass or less, and preferably 40 parts by mass or less relative to 100 parts by mass of a base rubber. If the content exceeds the upper limit, a resultant golf ball may be too hard, which may result in poor shot feeling. On the other hand, if the content is lower than the lower limit, it is required to increase the amount of an organic peroxide to impart appropriate hardness to a resultant golf ball, which may lower repulsion performance and make it difficult to obtain a sufficient flight distance.

Examples of the organic peroxide are dicumylperoxide, 1,1-bis(t-butylperoxy)-3,3,5-trimethylcyclohexane, 2,5-dimethyl-2,5-di(t-butylperoxy)hexane, and di-t-butylperoxide. Among these, dicumylperoxide is preferred. The content of dicumylperoxide is 0.3 part by mass or more, and preferably 0.4 part by mass or more, and 3 parts by mass or less, and preferably 2 parts by mass or less relative to 100 parts by mass of a base rubber. If the content is lower than the lower limit, a resultant golf ball may be too soft, which may lower repulsion performance and make it difficult to obtain a sufficient flight distance. On the other hand, if the content exceeds the upper limit, it is required to decrease the amount of a metal salt of α,β-unsaturated carboxylic acid, which also may lower repulsion performance and make it difficult to obtain a sufficient flight distance.

The kind of the filler is not specifically limited, as far as the filler is the one to be normally included in a core of a solid golf ball. An inorganic filler, e.g., zinc oxide, barium sulfate, calcium carbonate, and magnesium oxide may be used. A metal filler of high specific gravity such as tungsten powders, molybdenum powders, or a mixture thereof may be added. The content of the filler is 2 parts by mass or more, and preferably 3 parts by mass or more, and 50 parts by mass or less, and preferably 35 parts by mass or less relative to 100 parts by mass of a base rubber. If the content is lower than the lower limit, it is difficult to adjust the weight of the resulting golf ball. On the other hand, if the content exceeds the upper limit, the weight fraction of the base rubber decreases, thereby lowering repulsion performance.

Other components such as an organic sulfuric compound, an antioxidant, a peptizer or other ingredients to be normally usable in production of a core of a solid golf ball may be optionally added to the core of the inventive golf ball. It is preferred to add the antioxidant of not smaller than 0.1 part by mass and not larger than 1.0 part by mass, and the peptizer of not smaller than 0.1 part by mass and not larger than 5.0 parts by mass relative to 100 parts by mass of a base rubber.

The core of the inventive golf ball can be produced by mixing, kneading, and vulcanizing the aforementioned rubber composition in a die. The vulcanizing condition is not specifically limited, but normally is carried out at a temperature from 130 to 180° C., with a pressure from 2.9 to 11.8 MPa for 10 to 50 minutes.

The diameter of the core of the inventive golf ball is 40.8 mm or larger, and preferably 41.0 mm or larger, and 42.2 mm or smaller, preferably 42.0 mm or smaller, and more preferably 41.8 mm or smaller. If the core diameter is smaller than 40.5 mm, the cover thickness may be increased, thereby lowering repulsion performance. On the other hand, if the core diameter is larger than 42.0 mm, the cover thickness may be decreased, thereby failing to obtain sufficient effect by cover formation, and making a molding operation difficult.

The core to be used in the inventive golf ball may have a single-layered structure or a multi-layered structure having two or more layers. It is preferable to use a single-layered core (namely, two-piece golf ball) in the aspect of productivity. In the case where the core has a multi-layered structure, the surface hardness of the core is a hardness of the outermost layer of the multi-layered core. In the case of a core having a multi-layered structure, it is preferable to use a rubber composition containing cis-1,4-polybutadiene as a base rubber for forming the core innermost layer. It is possible to use a resin such as a thermoplastic resin as a base resin for forming the layer(s) other than the innermost layer.

It is possible to use a rubber composition identical or equivalent to that of the innermost layer, or a thermoplastic resin, particularly, an ionomer resin to be normally used in a cover of a golf ball as a base resin for forming a layer of the core other than the innermost layer. It is possible to use an ionomer resin identical or equivalent to the ionomer resin for composing the cover of the inventive golf ball.

Examples of the material of the layer of the core other than the innermost layer include, in addition to the aforementioned ionomer resin, a mixture of one or more kinds of an ionomer resin, a thermoplastic elastomer, a diene-based block copolymer, and a like compound. A thermoplastic elastomer identical or equivalent to the thermoplastic elastomer composing the cover of the inventive golf ball is usable.

The diene-based block copolymer has a double bond derived from a block copolymer, or a conjugated diene compound of a partially hydrogenated block copolymer. The base block copolymer is a block copolymer composed of a polymer block A having at least one kind of a aromatic vinyl compound as a main constituent, and a polymer block B having at least one kind of a conjugated diene compound as a main constituent. The partially hydrogenated block copolymer is obtained by hydrogenating the block copolymer. Preferred examples of the aromatic vinyl compound for composing the block copolymer are one or more kinds of styrene, α-methyl styrene, vinyl toluene, p-t-butyl styrene, 1,1-diphenyl styrene, and a like compound. Among these, styrene is preferred. Preferred examples of the conjugated diene compound are one or more kinds of butadiene, isoprene, 1,3-pentadiene, 2,3-dimethyl-1,3-butadiene, and a like compound. Among these, butadiene, isoprene, and a combination thereof are preferred. Preferred examples of the diene-based block copolymer are a block copolymer of styrene-butadiene-styrene (SBS) structure including a polybutadiene block having an epoxy group, and a block copolymer of styrene-isoprene-styrene (SIS) structure including a polyisoprene block having an epoxy group. Examples of the diene-based block copolymer are the ones sold under the trade name "Epofriend" from Daicel Chemical Industries, Ltd., such as "Epofriend A1010", and the ones sold under the trade name "Septon" from Kuraray Co., Ltd., such as "Septon HG-252".

The content of the thermoplastic elastomer or the diene-based block copolymer is preferably 1 part by mass or more, and 60 parts by mass or less, and preferably 35 parts by mass or less relative to 100 parts by mass of a base resin. If the content is lower than 1 part by mass, sufficient effects such as improvement in shot feeling by inclusion of these components are not obtainable. On the other hand, if the content exceeds 60 parts by mass, the layer of the core other than the innermost layer becomes too soft, thereby lowering repulsion performance. Further, compatibility to the ionomer resin decreases, which may likely to degrade durability of the golf ball.

In the case where the outer layer of the core other than the innermost layer is made of a rubber composition, first, a spherical core as an innermost layer is produced by mixing, and kneading a rubber composition for the innermost layer and by heat-pressing the rubber composition in a die at a temperature from 130 to 180° C. for 10 to 40 minutes. Then, a double-layered core comprising the innermost layer and the outer layer is produced by mixing and kneading a rubber composition for the outer layer, concentrically placing the rubber composition onto the innermost layer, and by heat-pressing the innermost layer with the rubber composition for the outer layer in a die at a temperature from 160 to 180° C. for 10 to 20 minutes. In the case where a layer of the core other than the innermost layer is made of a thermoplastic resin, it is possible to produce a double-layered core by directly injection molding the resin composition onto the innermost layer. It is preferred to finish the surface of the core by buffing in order to improve adhesion of the cover to the core.

In a golf ball according to an embodiment of the present invention, it is preferred to apply paint (coat) on the surface of the cover made of the aforementioned rubber composition. Further, it is possible to form dimples on the ball surface or to stamp a mark on the ball surface according to needs. Examples of the paint usable for the inventive golf ball are paints based on urethane resin, epoxy resin, acrylic resin, polyester resin, and a like resin. It is preferred to use a urethane resin paint, considering adhesion to the cover surface. A 2-pack-type urethane paint composed of a base resin and a curing agent is usable as such urethane resin paint. Polyol component is a primary ingredient of the base resin of the urethane resin paint. The polyol component includes the following urethane polyols.

Urethane polyols are synthesized by reaction of polyisocyanate with polyol. The kind of the polyisocyanate to be used for the synthesis is not specifically limited, as far as it has at least 2 isocyanate groups. Examples of the polyisocyanate are aliphatic, alicyclic, aromatic, aromatic/alicyclic isocyanate compounds such as hexamethylene diisocyanate (HDI), xylylene diisocyanate (XDI), hydrogenated xylylene diisocyanate ($H_6$XDI), isophorone diisocyanate (IPDI), tetramethylxylylene diisocyanate (TMXDI), and hydrogenated diphenylmethane diisocyanate ($H_{12}$XDI). Among these, discoloration-free polyisocyanate (aliphatic and alicyclic polyisocyanate) is preferred in the aspect of weatherability.

The kind of the polyol for producing urethane polyol is not specifically limited, as far as the polyol has plural hydroxyl groups. Examples of the polyol are a polyol having a low molecular weight, and a polyol having a high molecular weight. Examples of the polyol having a low molecular weight include diols such as ethylene glycol, diethylene glycol, triethylene glycol, butylene glycol 1,3-butanediol, 1,4-butanediol, neopentyl glycol, and 1,6-hexanediol; and triols such as glycerin, trimethylolpropane, and hexanetriol.

Examples of the polyol having a high molecular weight are polyether polyols obtained by reaction of an initiator having an active hydrogen atom with alkylene oxide; condensed polyester polyols obtained by dehydration condensation of dibasic acid such as adipic acid with glycol or triol; lactone polyester polyols obtained by open-ring polymerization of lactam such as ε-caprolactam; polycarbonate diols synthesized with use of cyclic diol; and polymer polyols such as acrylic polyol obtained by optional introduction of a hydroxyl group to acrylic copolymer. Examples of the polyether polyol include polyethylene glycol, polypropylene glycol, and polytetramethylene glycol. Examples of the condensed polyester polyol include polyethylene adipate. Examples of the lactone polyester polyol include poly-ε-caprolactone.

Among these polyols, preferred are polyols having a weight-average molecular weight from 50 to 2,000, and particularly preferred are polyols having a weight-average molecular weight from about 100 to 1,000. One or more than one of these polyols may be mixed.

Urethane polyol forms urethane bond by reaction of the diisocyanate with polyol. Urethane polyol is a polyol having a hydroxyl group each at both terminals thereof. It is preferable to set the ratio of urethane bond at not smaller than 0.1 mmol/g and not larger than 5 mmol/g relative to 1 g of urethane polyol. The ratio of urethane bond has a close relation to stiffness of the paint layer to be formed on the cover surface. If the ratio of urethane bond is smaller than 0.1 mmol/g, the urethane concentration in the paint layer to be formed decreases, which may lower scuff resistance. On the other hand, if the ratio of urethane bond exceeds 5 mmol/g, a resultant paint layer may be too hard, which makes the paint layer difficult to follow deformation of the ball body. As a result, crack may be generated in the golf ball.

The weight-average molecular weight of the urethane polyol is 4,000 or larger, and preferably, 4,500 or larger, and 10,000 or smaller, and preferably 9,000 or smaller. If the weight-average molecular weight of the urethane polyol is smaller than 4,000, it takes a longer time in drying, thereby lowering workability and productivity. On the other hand, the weight-average molecular weight of the urethane polyol is larger than 10,000, the hydroxyl group value of the urethane polyol becomes relatively small, and the amount of hydroxyl groups to be reacted with the outside surface of a golf ball body after coating of the paint is reduced, which may lower adhesiveness of the paint layer to the cover surface. If the weight-average molecular weight of the urethane polyol is 9,000 or smaller, a fine paint layer is formable with less likelihood of adhesiveness lowering even in contact with moisture.

The hydroxyl group value (mgKOH/g) of the urethane polyol is 15 or more, preferably 73 or more, and 130 or less, and preferably 120 or less. If the hydroxyl group value of the urethane polyol is less than 15 mgKOH/g, the amount of hydroxyl groups to be reacted with the curing agent is insufficient, with the result that adhesiveness to the golf ball body may be lowered. On the other hand, if the hydroxyl group value of the urethane polyol is larger than 130 mgKOH/g, it takes a longer time in reaction with the curing agent, which resultantly extends a drying time, and lowers productivity of golf ball. Furthermore, the golf ball likely to cause crack when impact is applied thereto.

The polyurethane polyol is synthesized by diluting a raw material polyol with a solvent, and gradually adding polyisocyanate with addition of a reaction catalyst (e.g., dibutyl tin laurylate) for forming urethane bond. The polyurethane polyol has a hydroxyl group at a terminal thereof. The ratio of urethane bond can be determined by regulating a molecular weight of the raw material polyol, a mixing ratio of polyol to polyisocyanate, or the like.

Preferably, the polyol component for composing the base resin of the paint is the aforementioned urethane polyol. In other words, it is preferred to use the aforementioned urethane polyol substantially exclusively, as the base resin. Alternatively, the base resin may include polyol that is compatible to urethane polyol and does not have a urethane bond, with the aforementioned urethane polyol.

The kind of the polyol usable in the above case is not specifically limited. Polyol usable for synthesis of urethane polyol, e.g., low-molecular diols, low-molecular triols, and polymer polyols may be used. Examples of the polyols include: low-molecular diols such as ethylene glycol, diethylene glycol, triethylene glycol, butylene glycol, 1,3-butanediol, 1,4-butanediol, neopentyl glycol, and 1,6-hexane diol; low-molecular triols such as glycerin, trimethylol propane, and hexane triol; polyether polyols such as polyethylene glycol, polypropylene glycol, and polytetramethylene glycol; polycarbonate diols; and acrylic polyols.

In the case where the base resin contains polyol that does not have a urethane bond, preferably, the content of the urethane polyol to the base resin is 50% by mass or more, and more preferably, 80% by mass or more. If the content of the urethane polyol to the base resin becomes smaller than 50% by mass, the content of the urethane polyol to the base resin is relatively small, thereby extending a drying time.

Polyisocyanate identical or equivalent to the polyisocyanate used in synthesis of the urethane polyol is usable as a curing agent for the paint. It is preferred to use discoloration-free polyisocyanate (aliphatic and alicyclic isocyanate) in order to prevent discoloration of the coat. The polyisocyanate may be used alone or in combination of two or more kinds thereof.

The paint to be used in the inventive golf ball may include various additives, diluents or the like, in addition to the above components. Examples of the additive may be additives which are generally allowable to be included in the paint for golf balls such as UV absorber (antioxidant), oxidation inhibitor, light stabilizer, silicon-based slip agent, leveling agent, viscosity modifier, fluorescent whitening agent, blocking inhibitor, curing catalyst, and colorant/pigment. These additives may be included either in the base resin or the curing agent, or both in the base resin and the curing agent. The content of the additives is not smaller than 0.1 part by mass and not larger than 10 parts by mass relative to 100 parts by mass of a solid content of a resin.

Examples of the diluent to be included in the paint include alcohols such as water and isopropyl alcohol, aromatic compounds such as toluene, hydrocarbons such as hexane, esters such as acetate ester, and ketones such as methylethylketone. The content of the diluent is not specifically limited, but preferably is not smaller than 5% by mass and not larger than 50% by mass.

The paint for the inventive golf ball having the above composition is used in such a manner that the base resin and the curing agent are mixed with each other immediately before the use. The mixing ratio of the base resin and the curing agent is such that the equivalent ratio (isocyanate group to hydroxyl group) of isocyanate group in the curing agent to hydroxyl group in the base resin is 0.5 or more, and preferably 0.9 or more, and 2.0 or less, and preferably 1.5 or less.

The process for applying the coat is not specifically limited, and a well-known coating process of applying a 2-pack type curable paint is usable. According to such a known process, after the base resin and the curing agent are mixed, and surface treatment such as cleaning is conducted for the ball surface, the paint is applied onto the ball surface by an air spray paint gun, electrostatic coating, or a like technique. In the case where a spray gun is used, the base resin and the curing agent may be mixed with each other by a small amount, so that the mixture is loaded in the gun and sprayed little by little. Alternatively, it is possible to mix the base resin and the curing agent at a constant mixing ratio and continuously feed the mixture into the spray gun through a line mixer such as a static mixer along a paint feeding path which is disposed immediately before the spray gun with use of a pump capable of feeding the two liquids at the constant ratio, or to use an air spray system equipped with a mixing ratio controller.

The deformation of the inventive golf ball is 2.50 mm or larger, preferably 2.55 mm or larger, and more preferably 2.60 mm or larger, and 3.10 mm or smaller, preferably 3.00 mm or smaller, and more preferably 2.85 mm or smaller when a load ranging from 98N (10 kgf) as an initial load to 1275N (130 kgf) as a final load is applied to the golf ball. If the deformation is smaller than 2.50 mm, the shot feel of such a golf ball may be hard and poor. On the other hand, if the deformation exceeds 3.10 mm, such a golf ball may be too soft, and the shot feel of the golf ball may be heavy and poor.

The inventive golf ball has a diameter of 42.67 mm or larger (preferably from 42.67 to 43 mm), and a weight of 45.93 g or less in compliance with a rule by United States Golf Ball Association.

EXAMPLES

In the following, the present invention is illustrated in detail with Examples, which however, do not limit the invention. Adequate modification is allowable as far as it does not depart from the object of the present invention described above or below, and every such modification is intended to be embraced in the technical scope of the present invention.

[Evaluation Method]

(1) Weatherability

A weatherability test (JIS-D0205) was conducted by irradiation of light onto golf balls for 120 hours in a chamber of a temperature at 63° C., humidity of 50%, with showers of rain for 12 minutes in every 60 minutes, using a Sunshine Super Long Life Weather Meter "WEL-SUN-HC/B" manufactured by Suga Test Instruments Co., Ltd. The color tone (L value, a value, b value) of each golf ball at the same position before and after the irradiation was measured with use of a colorimeter "CR-221" manufactured by Konica Minolta Co., Ltd. Differences in L value, a value, and b value (namely, ΔL, Δa, Δb) between before and after the irradiation were obtained, and ΔE was calculated by implementing the following equation. The value ΔE represents a degree of discoloration The larger the ΔE is, the greater the degree of discoloration is.

$$\Delta E=[(\Delta L)^2+(\Delta a)^2+(\Delta b)^2]^{1/2}$$

(2) Adhesiveness Against Hitting (Impact Resistance)

The coat adhesiveness against hitting was evaluated with use of the golf balls after the weatherability test. Specifically, the coat adhesiveness against hitting was evaluated according to the following criteria by attaching a driver (1W) to a swing robot manufactured by True Temper, Co., causing the robot to hit each golf ball at a head speed of 45 m/sec 100 times, and by observing peeled states of the respective coats of the golf balls.

Evaluation criteria:

⊚: no peeling was observed.

○: the sum of the peeled areas was 3% or less relative to the entirety of the coat.

Δ: the sum of the peeled areas was larger than 3% and not larger than 25% relative to the entirety of the coat.

x: the sum of the peeled area was larger than 25% relative to the entirety of the coat.

(3) Repulsion Performance

A 200 g aluminum tubular object was hit against each golf ball at a speed of 45 m/sec, and the respective speeds of the tubular object and the golf balls before and after the hitting were measured. A repulsion index of each golf ball was calculated based on the speeds and the weights of the golf balls and the tubular object. The measurement was conducted five times with respect to each of the golf balls, and the average was calculated. The repulsion index is a numerical value indicative of the respective averages of the golf balls when the average of the golf ball No. 1 is represented as 100. The larger the repulsion index is, the higher the repulsion force is.

[Production of Core]

Spherical cores were produced by mixing and kneading the rubber composition for the core shown in Table 1, and by heat-pressing the rubber composition in a die under the conditions as shown in Table 1.

TABLE 1

| Core composition (mass part) | |
|---|---|
| BR-18 | 100 |
| zinc acrylate | 33 |
| zinc oxide | 12 |
| diphenyl disulfide | 0.5 |
| dicumyl peroxide | 1 |
| Molding condition | |
| temperature (° C.) | 170 |
| time (min) | 15 |
| Ball property | |
| core diameter (mm) | 41.2 |
| core compression ratio (mm) | 2.95 |

In Table 1, BR-18 is high cis polybutadiene (content of cis-1,4-bond: 96%) manufactured by JSR Corporation, diphenyl disulfide is a product manufactured by Sumitomo Seika Chemicals Co., Ltd., and dicumyl peroxide is a product manufactured by NOF Corporation.

[Preparation of Cover Composition]

Pelletized cover composition was prepared by mixing and kneading the materials shown in Table 2 with use of a dual axial extruder. The extruding conditions were: a screw diameter of 45 mm, the screw rotation number of 200 rpm, and the ratio of length to diameter (L/D) of the screw at 35. The mixture was charged in a die of the extruder and heated at a temperature from 200 to 260° C. The following is a description on the raw materials for the cover composition shown in Table 2.

Elastoran ET880 is a thermoplastic polyurethane elastomer using 4,4'-diphenylmethane diisocyanate (MDI) manufactured by BASF Japan Ltd.;

Elastoran XNY97A is a thermoplastic polyurethane elastomer using 4,4'-dicyclohexylmethane diisocyanate ($H_{12}$MDI: hydrogenated MDI) manufactured by BASF Japan Ltd.;

Pebax 5533SN00 is a thermoplastic polyether polyamide elastomer manufactured by Atofina Japan Co., Ltd;

Himilan 1605 is an ionomer resin of sodium-ion-neutralized ethylene and methacrylic acid copolymer manufactured by Dupont Mitsui Polychemicals Co., Ltd.;

Himilan 1706 is an ionomer resin of zinc-ion-neutralized ethylene and methacrylic acid copolymer manufactured by Dupont Mitsui Polychemicals Co., Ltd.;

Surface-treated titanium oxide-1 is "D918" (surface-treatment: $SiO_2.H_2O/ZrO_2.H_2O/Al_2O_3.H_2O$) manufactured by Sakai Chemical Industry Co., Ltd.;

Surface-treated titanium oxide-2 is "R-62N" (surface-treatment: $ZrO_2.Al_2O_3$) manufactured by Sakai Chemical Industry Co., Ltd.;

Surface-treated titanium oxide-3 is "STR-60S" (surface-treatment: Ce/Sn/Zr/Al) manufactured by Sakai Chemical Industry Co., Ltd.; and Surface-untreated titanium oxide is "Tipaque A-220" manufactured by Ishihara Sangyo Kaisha, Ltd.

[Production of Cover]

Covers were formed each by molding the cover composition into a half shell of a substantially hollow hemispherical shape. Then, each golf ball body was produced by encasing the aforementioned core in two half shells, and by heat-pressing the jointed half shells with the core in a die at a temperature of 160° C. for 2 minutes. After taking out each golf ball body from the die, and removing the burr, a clear paint was applied onto the surface of each golf ball body. Thus, a golf ball each having 42.8 mm in diameter and 45.4 g in weight was obtained. Evaluation results with respect to the golf balls are as shown in Table 2.

[Preparation of Coating Composition]

A 2-pack type curable urethane paint having the following composition was used as the clear coat.

base resin: a mixture of polyether polyol and polyester polyol (hydroxyl group value: 80 mgKOH/g)

curing agent: hexamethylene diisocyanate mixing ratio of base resin and curing agent: NCO/OH=1.2/1.0 (in molar ratio)

Golf ball Nos. 1 through 7 are examples in which the cover containing the surface-treated titanium oxide is used. All the golf ball Nos. 1 through 7 showed good weatherability, coat adhesiveness, and repulsion performance. Particularly, the results on golf ball Nos. 1 through 3 show that increase of the content of the surface-treated titanium oxide contributes to improvement in ΔE and coat adhesiveness. A smaller value of ΔE means less discoloration or degradation of the cover with time, and superior weatherability.

Golf ball Nos. 8 through 10 are examples in which the cover contains the surface-untreated titanium oxide. Golf ball No. 8 has a large ΔE value (=9.8), as compared with the golf ball No. 1 using the cover made of the same base resin as the golf ball No. 8. The golf ball No. 8 has remarkably poor weatherability and coat adhesiveness. Golf ball Nos. 9 and 10 have poor weatherability and coat adhesiveness, as compared with the golf balls using the cover made of the base resin identical in composition to that of the golf ball Nos. 9 and 10. Golf ball No. 11 is an example in which the content of the surface-treated titanium oxide is exceedingly small. The ΔE value of the golf ball No. 11 is as large as 8.7, which implies that the golf ball is likely to cause discoloration, and has poor weatherability. Golf ball No. 12 is an example in which the cover contains an excessively large content of the surface-treated titanium oxide. Although the golf ball No. 12 shows superior weatherability (ΔE=2.1), repulsion performance of the golf ball No. 12 is low due to an excessive content of titanium oxide.

As mentioned above, the base resin composing the cover of the inventive golf ball contains a predetermined content of titanium oxide, wherein the titanium oxide is surface-treated with an oxide including at least one element selected from the group consisting of aluminum, silicon, zinc zirconium, tin, and cerium, and/or a hydrate thereof. This makes it possible to produce a golf ball with less or no discoloration or degradation with time, and having superior weatherability.

According to an aspect of the present invention, the titanium oxide which is surface-treated with at least one selected from the group consisting of a silicon oxide, a zirconium oxide, an aluminum oxide, and a hydrate thereof is preferred, because inclusion of such titanium oxide provides a resultant golf ball with improved weatherability.

TABLE 2

| | Golf Ball No. | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Cover composition (mass part) | | | | | | | | | | | | |
| Elastoran ET880 | 80 | 80 | 80 | 80 | 80 | — | — | 80 | — | — | 80 | 80 |
| Elastoran XNY97A | — | — | — | — | — | 80 | — | — | 80 | — | — | — |
| Pebax 5533SNOO | 20 | 20 | 20 | 20 | 20 | 20 | — | 20 | 20 | — | 20 | 20 |
| Himilan 1605 | — | — | — | — | — | — | 50 | — | — | 50 | — | — |
| Himilan 1706 | — | — | — | — | — | — | 50 | — | — | 50 | — | — |
| Surface-treated titanium oxide-1 | 1 | 4 | 8 | — | — | 4 | 4 | — | — | — | 0.3 | 13 |
| Surface-treated titanium oxide-2 | — | — | — | 4 | — | — | — | — | — | — | — | — |
| Surface-treated titanium oxide-3 | — | — | — | — | 4 | — | — | — | — | — | — | — |
| Surface-untreated titanium oxide | — | — | — | — | — | — | — | 4 | 4 | 4 | — | — |
| Ball property | | | | | | | | | | | | |
| weatherability (ΔE) | 5.2 | 2.7 | 2.4 | 2.8 | 2.9 | 1 | 1.4 | 9.8 | 2.1 | 2.5 | 8.7 | 2.1 |
| adhesiveness | ○ | ◎ | ◎ | ○ | ○ | ◎ | ◎ | X | Δ | Δ | Δ | ◎ |
| repulsion performance (index) | 100 | 100 | 99 | 100 | 100 | 97 | 103 | 100 | 97 | 103 | 100 | 95 |

According to another aspect of the invention, the golf ball may have a single-layered coat.

This application is based on Japanese Patent Application No. 2004-056682 filed on Mar. 1, 2004 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A golf ball comprising:

a core; and a cover for covering the core, the cover containing 0.5 to 10 parts by mass of a titanium oxide relative to 100 parts by mass of a base resin composing the cover, wherein the titanium oxide is surface-treated with an oxide including at least one element selected from the group consisting of aluminum, silicon, zinc, zirconium, tin, and cerium, and/or a hydrate thereof.

2. The golf ball according to claim 1, wherein the titanium oxide is surface-treated with at least one selected from the group consisting of a silicon oxide, a zirconium oxide, an aluminum oxide, and a hydrate thereof.

3. The golf ball according to claim 1, further comprising a single-layered coat.

4. A golf ball comprising:

a core; and a cover for covering the core, the cover containing 0.5 to 10 parts by mass of a titanium oxide relative to 100 parts by mass of a base resin composing the cover, wherein the titanium oxide is surface-treated with an oxide including at least one element selected from the group consisting of zirconium, tin, and cerium, and/or a hydrate thereof.

5. A golf ball according to claim 1, wherein the oxide used to surface-treat the titanium oxide is an oxide and/or hydrate of aluminum.

6. A golf ball according to claim 1, wherein the oxide used to surface-treat the titanium oxide is an oxide and/or hydrate of silicon.

7. A golf ball according to claim 1, wherein the oxide used to surface-treat the titanium oxide is an oxide and/or hydrate of zinc.

8. A golf ball according to claim 1, wherein the oxide used to surface-treat the titanium oxide is an oxide and/or hydrate of zirconium.

9. A golf ball according to claim 1, wherein the oxide used to surface-treat the titanium oxide is an oxide and/or hydrate of tin.

10. A golf ball according to claim 1, wherein the oxide used to surface-treat the titanium oxide is an oxide and/or hydrate of cerium.

* * * * *